United States Patent [19]

Meyers et al.

[11] 4,233,119

[45] Nov. 11, 1980

[54] ASCENSION PIPE AND ELBOW CLEANING APPARATUS

[75] Inventors: Leo J. Meyers; Louis A. Grant, both of Pittsburgh, Pa.

[73] Assignee: Louis A. Grant, Inc., Pittsburgh, Pa.

[21] Appl. No.: 5,841

[22] Filed: Jan. 23, 1979

[51] Int. Cl.[2] ..... C10B 43/06

[52] U.S. Cl. ..... 202/241; 15/93 A; 248/647; 248/654

[58] Field of Search ..... 202/241; 201/2; 15/93 A, 104.1; 248/647, 651, 654

[56] References Cited

U.S. PATENT DOCUMENTS

| | | | |
|---|---|---|---|
| 3,400,052 | 9/1968 | Olsen | 202/241 |
| 3,480,514 | 11/1969 | Kinzler et al. | 202/241 |
| 3,493,200 | 2/1970 | Huffman | 248/654 |
| 3,972,781 | 8/1976 | Grouye et al. | 202/241 |
| 4,012,021 | 3/1977 | Duceppe | 248/651 |
| 4,040,584 | 8/1977 | Thompson | 248/654 |

FOREIGN PATENT DOCUMENTS

| | | | |
|---|---|---|---|
| 2142707 | 3/1973 | Fed. Rep. of Germany | 202/241 |
| 1297228 | 5/1962 | France | 248/651 |
| 277721 | 11/1970 | U.S.S.R. | 202/241 |
| 362039 | 2/1973 | U.S.S.R. | 15/93 A |

*Primary Examiner*—Frank W. Lutter
*Assistant Examiner*—Roger F. Phillips
*Attorney, Agent, or Firm*—Parmelee, Miller, Welsh & Kratz

[57] ABSTRACT

An improved cleaning apparatus for the removal of carbonaceous deposits from the inner surfaces of the ascension pipe elbows and ascension pipe employed on coke ovens. The cleaning apparatus is comprised of a base support, a movable support and a cleaning element. The base support is mounted on a larry car and the movable support is superimposed upon and connected to the base support. The cleaning element is pivotally attached to the movable support and is equipped with a cleaning head mounted on the end of an arm and means for moving the arm in and out of the pipe which is to be cleaned. There is also provided means for adjusting the movable support in either a horizontal or a vertical position so that after the cleaning element has been initially aligned with the lateral leg of the elbow by moving the larry car and by moving the cleaning element on its pivotal connection with the movable support, the cleaning element may be universally further aligned so as to compensate for thermally caused misalignment in the ascension pipe elbow by adjusting the position of the movable support. In a preferred embodiment, means are provided to also move the cleaning element into initial alignment with the vertical leg of the elbow and with the ascension pipe itself and to adjust the position of the movable support so as to further align the cleaning element with these pipes. In this preferred embodiment, the arm of the cleaning element is also telescopically extendable.

15 Claims, 6 Drawing Figures

ASCENSION PIPE AND ELBOW CLEANING APPARATUS

BACKGROUND OF THE INVENTION

This invention relates to coke ovens and, more particularly, to apparatus for cleaning the ascension pipes and the ascension pipe elbows employed on such ovens.

Coke ovens are generally equipped with one or two offtakes to carry off the volatile products liberated in the coking process. These gases pass through a duct in the oven's top and enter a vertically extending, refractory lined ascension pipe. These ascension pipes, which are also commonly referred to as standpipes, are connected at their upper ends to structures known as ascension pipe elbows. The ascension pipe elbows extend vertically from the upper end of the ascension pipe in a vertical leg and then curve outwardly and downwardly in a lateral leg to where they connect with a gas collecting main. Because the gases which are conducted in these pipes have entrained with them large amounts of carbonaceous solid material which tends to adhere to the inner surfaces of these pipes, the gas passages through the ascension pipes and the ascension pipe elbows will quickly become seriously restricted if these deposits are not regularly removed. To facilitate such removal, ascension pipe elbows are customarily designed with an access opening equipped with a cap valve known as an elbow cover. When this elbow cover is open, it vents the coke oven to the atmosphere and allows a cleaning instrument to be inserted through the access opening and into the interior of the ascension pipe and elbow. While this task may be performed manually, such manual cleaning is not a preferred method because it is time consuming and arduous. Further, because of the high temperature of the pipes and the elevated position of the work area, this procedure is also hazardous to the workmen carrying it out. This procedure may also present other dangers to these workmen since gases present in this work area have been alleged to be carcigenous. Consequently, a number of devices have been developed which allow for the mechanized cleaning of ascension pipes and ascension pipe elbows. A common characteristic of many of these devices is that they are mounted on a coke oven larry car which moves on tracks laid on the top of the oven and adjacent the ascension pipes. Many of these devices are equipped with a cleaning element which includes an extendable arm with a terminal cleaning head mounted thereon. The devices are positioned for use by moving the larry car until the cleaning element is adjacent to the ascension pipe. Thereafter, when the arm is extended the cleaning head is projected through the access opening and into the lateral leg. In certain designs, the device is capable, after the extendable arm has been withdrawn from the lateral leg, of being adjusted in position so that the cleaning element is disposed in a vertical position and aligned so that the arm may be moved and the cleaning head projected through the access opening and into the vertical leg of the elbow and into the ascension pipe. The aforementioned features are, for example, incorporated into the apparatus disclosed in U.S. Pat. No. 3,400,052.

A problem, however, may be encountered in the employment of such apparatus. Because the elbows may reach temperatures in the range of 1000°–1500° F. and because they are exposed to continually changing ambient conditions, it is found that they undergo thermal expansion or contraction such that they may be observed to bend or lean. Accordingly, it is also found that where the elbow access opening and the elbow itself may share a common vertical center line at one temperature, such a condition may not exist at an elevated temperature. Under conditions where elbows lean in this manner, the cleaning devices described above may be inefficient, for while they may be adjusted so as to initially align their cleaning elements with the access opening, they lack the capacity to compensate for thermally caused misalignments between the access opening and the legs of the elbow itself. It is, therefore, the object of the present invention to provide a cleaning apparatus which, after it is initially aligned with the elbow opening, may thereafter be further aligned to compensate for thermal misalignment in the elbows.

SUMMARY OF THE INVENTION

The present invention is an apparatus for the cleaning of the inner surface of the lateral legs of ascension pipe elbows and, in a preferred embodiment, also of the vertical leg of the elbow and the ascension pipe itself in which means are provided to compensate for thermal misalignment in these pipes. The apparatus is mounted on a larry car which travels on rails mounted adjacent to the coke oven ascension pipes. The base support section of the apparatus is bolted to the larry car. This base support is connected to a movable support by means which allow the position of the movable support to be both horizontally and vertically adjusted. The movable support is, itself, pivotally connected to a cleaning element. The cleaning element is comprised of an arm and a means for moving said arm in and out of a lateral leg of an elbow. The arm is also equipped with a cutting head at its terminal end and a means to cause its rotation so that the rotating cutting head will remove carbonaceous deposits on the inner surfaces of pipes into which the arm is moved.

The cleaning element and its arm and cutting head are initially aligned with the lateral leg of the elbow by moving the larry car until it is adjacent to the elbow and by then pivoting the cleaning element at its connection with the movable support until it is at the correct angle for entry through the access opening into the lateral leg. If thermal misalignment has not occured in the lateral leg, the arm may be extended and cleaning may be accomplished. If, however, the lateral leg has been bent, the alignment of the cleaning apparatus may be still further refined so as to compensate for such misalignment. That is, the movable support may be moved either horizontally, vertically or in both directions until the cleaning element is in such a position so that its extendable arm may be inserted to the entire length of the lateral leg.

In a preferred embodiment of the present invention, the cleaning apparatus may also be used to clean the inner surfaces of the vertical leg of the elbow as well as that of the ascension pipe. In this preferred embodiment, the cleaning apparatus is provided with means for moving the movable support in a vertical arc away from the base support such that after the extendable arm has been withdrawn from the lateral arm, it may be initially aligned with the inner surfaces of the vertical leg of the elbow and the ascension pipe by activating the means for moving the movable support in a vertical arc away from the base support. If the vertical leg of the elbow or the ascension pipe has been deformed, the position of the movable support may be adjusted still further to compensate for this deformation. In this preferred embodiment, a means is also provided for telescopically extending the arm.

BRIEF DESCRIPTION OF THE DRAWINGS

The present invention is more fully described in the drawings, in which.

DESCRIPTION OF THE PREFERRED EMBODIMENT

Figure 1:
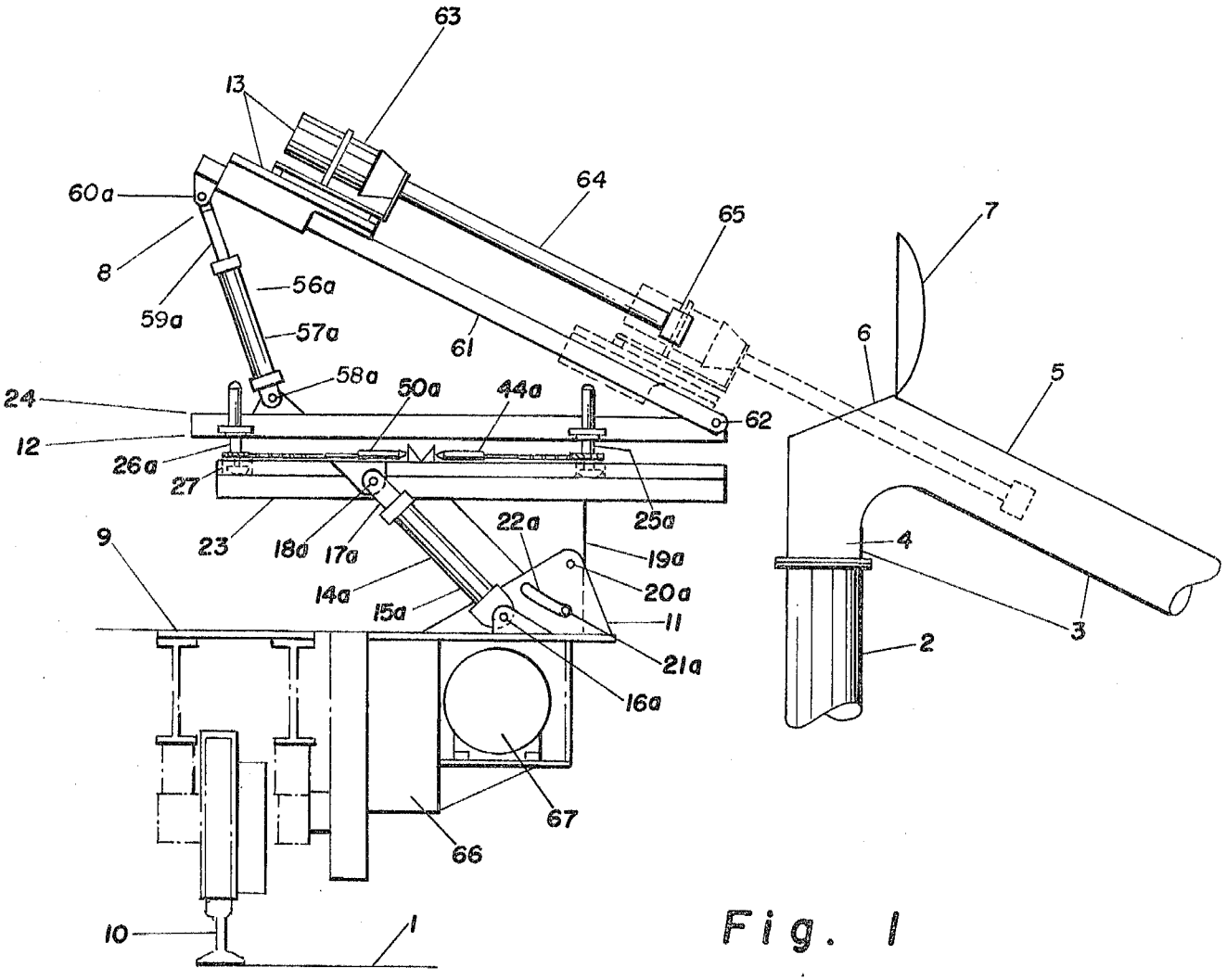
FIG. 1 is a side elevational view of the present invention in which the arm is shown in solid lines in its rear position and is shown in broken lines in a forward position.

Referring to the drawings, the top fragment of coke oven 1 is shown in fragment. The oven 1 has mounted therealong an ascension pipe 2 which is connected at its lower end to the offtake duct (not shown) of the coke oven. The ascension pipe 2 extends vertically from the offtake duct and is connected at its upper end to an ascension pipe elbow 3. The elbow extends first upwardly in a vertical leg 4 and then outwardly and downwardly in a lateral leg 5 to where it connects with a gas collecting main (not shown). The elbow 3 has an access opening 6 at the junction between the vertical leg 4 and the lateral leg 5. Pivotally mounted on the elbow adjacent to access opening 6 is the elbow cover 7 which serves to close off the interior of the ascension pipe 2 and the elbow 3 when cleaning is not in progress.

Figure 2:
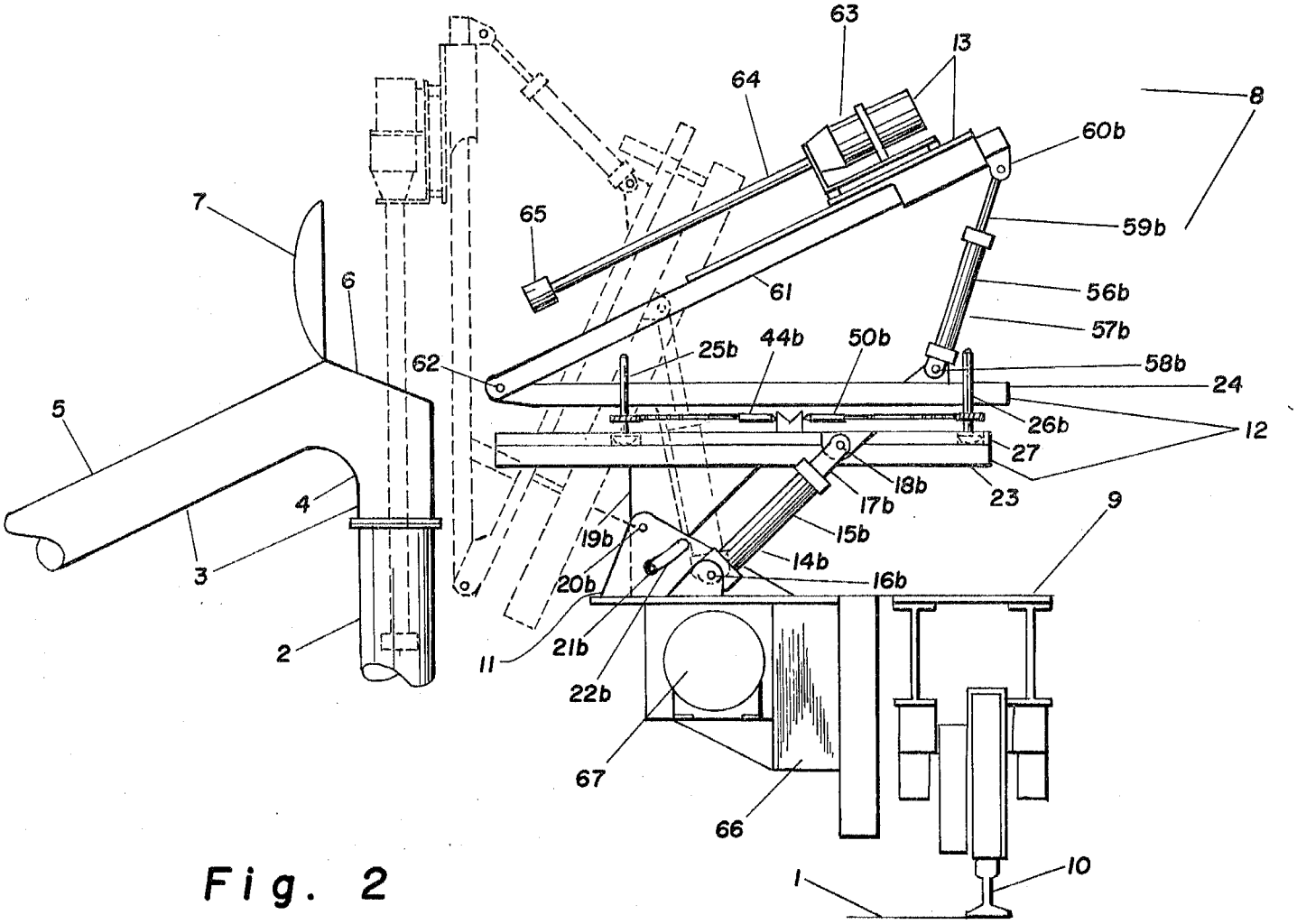
FIG. 2 is a view of the present invention similar to that shown in FIG. 1, except that it is shown from its other side, in which the parts of the apparatus are shown in solid lines in their positions when the apparatus is employed to clean the lateral leg of the ascension pipe elbow and in which the parts of the apparatus are shown in broken lines in their position when the apparatus is employed to clean the vertical leg of the elbow and the ascension pipe. Further, the arm shown in broken lines is in its extended position.

As shown in FIGS. 1 and 2, the cleaning apparatus 8 for the removal of carbonaceous deposits from the ascension pipe 2 and the elbow 3 is mounted on a larry car 9 which travels across the coke oven on longitudinally arranged rails 10 which run adjacent to the ascension pipe 2 and the elbow 3. The principal elements of the cleaning apparatus 8 are a base support 11, a movable support 12 and a cleaning element 13. The base support 11 is affixed to the larry car 9 and is connected to the movable support 12 by a pair of fluid driven piston and cylinder units **14*a* and 14*b*. Cylinders 15*a* and 15*b* of piston and cylinder units 14*a* and 14*b* are pivotally connected to base support 11 at connections 16*a* and 16*b* and the pistons 17*a* and 17*b* of piston and cylinder units 14*a* and 14*b* are pivotally connected to the movable support 12 at connections 18*a* and 18*b*. The base support 11 is also connected to the movable support 12 by a pair of movable support arms 19*a* and 19*b*. The movable support arms 19*a* and 19*b* are pivotally connected at connections 20*a* and 20*b* to the base support 11 and projections 21*a* and 21*b* on the movable support arms 19*a* and 19*b* extend through arcuate grooves 22*a* and 22*b* in the base support 11 and move along said grooves as the movable support arms 19*a* and 19*b* rotate on connections 20*a* and 20*b*. As will be hereinafter more fully explained, the movable support arms 19*a* and 19*b* as well as the piston and cylinder units 14*a* and 14*b* allow the movable support 12 to move in a vertical arc away from the base support 11**.

Included in the movable support 12 are a lower plate 23 and an upper plate 24. The lower plate comprises that portion of the movable support 12 which is connected to the pistons **17*a* and 17*b* at connections 18*a* and 18*b*. The lower plate 23 is also attached to the movable support arms 19*a* and 19*b* such that the movable support arms 19*a* and 19*b* extend below the lower plate 23 and are connected to the base support 11** in the manner heretofore described.

Lower plate 23 is connected at an adjustable distance from upper plate 24 by four fluid driven jacks, **25*a*, 25*b*, 26*a* and 26*b*. The upper plate 24 is superimposed upon the lower plate 23 and two of the jacks 25*a* and 25*b* connect said plates at their front ends, jack 25*a* being disposed to one side of the plates while jack 25*b* is disposed to the other side of the plates. The jacks 26*a* and 26*b* connect the upper plate 24 and the lower plate 23 at their rear ends and are also disposed to opposite sides of said plates. The jacks 25*a*, 25*b*, 26*a* and 26*b* are fixed to the upper plate 24 and thrust against the top surface of the lower plate with their rounded lower terminal supports. Because the jacks are not fixed to the lower plate 23, they will slide across the surface of the lower plate 23 when, as will be explained hereafter, the upper plate 24 moves with respect to the lower plate 23. Further, said jacks may be independently raised or lowered so that, for example, jacks 25*a* and 26*a* may be raised to a certain level while jacks 25*b* and 26*b* are kept at a lower level so that the upper plate 24 becomes tilted with respect to the lower plate 23. The plates may thereafter be brought into parallel relation by raising jacks 26*a* and 26*b* to the same level as jacks 25*a* and 26*b*. By changing the relative levels of the jacks, the upper plate 24 may be selectively disposed in a plane which is either parallel to the plane of the lower plate 23 or in a plane which intersects the plane of the lower plate at an angle of up to 4°. The significance of this capability with respect to the overall operation of the cleaning apparatus 8** will be explained more fully hereinafter.

Figure 5:
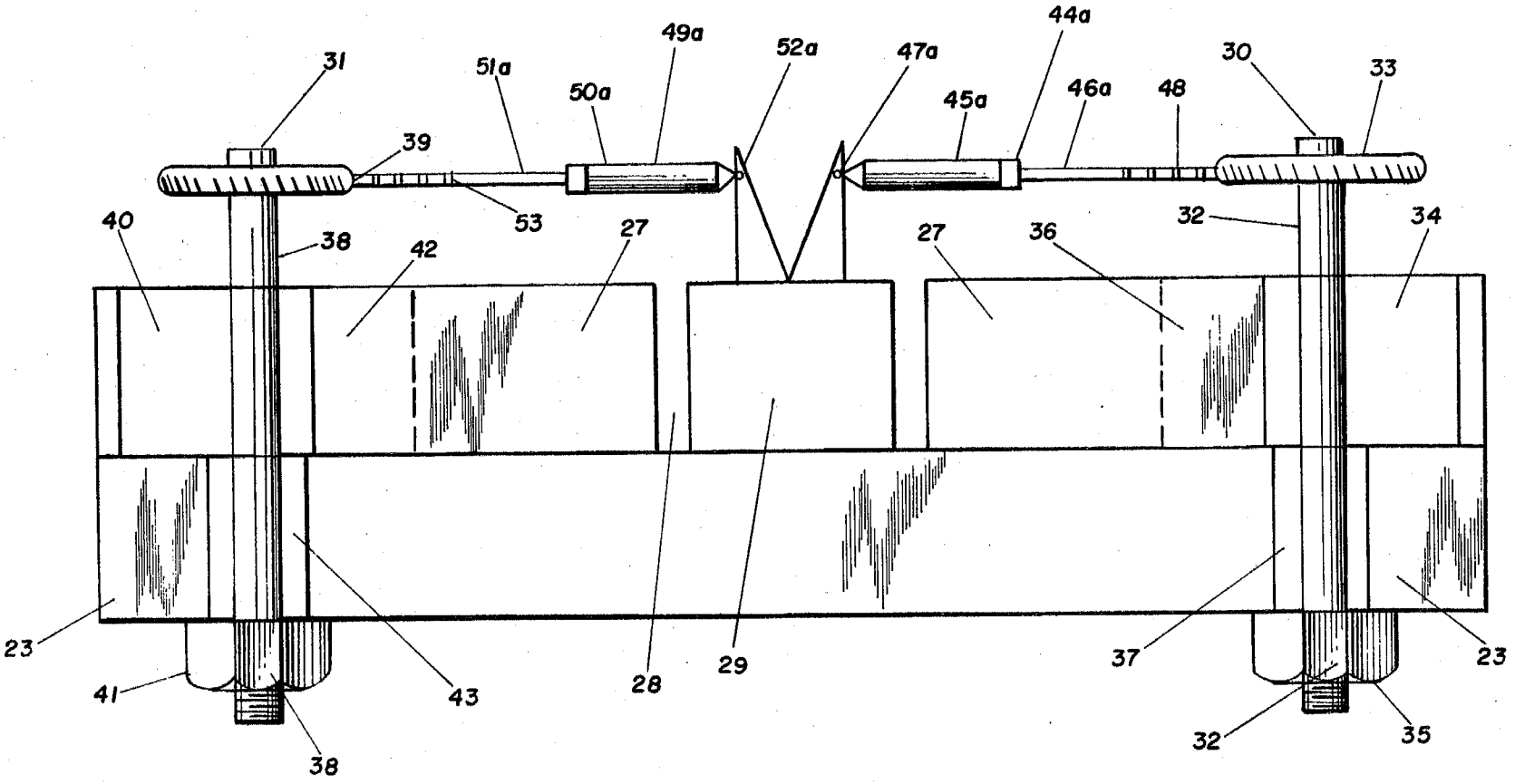
FIG. 5 is a cut away side view of the cam plate of the apparatus of the present invention including certain other adjacent parts.

Resting on top of lower plate 23 and capable of certain limited sliding motion thereon is cam plate 27 (FIG. 5). Cam plate 27 has a central, oblong aperture 28 through which projection 29 of lower plate 23 extends. Also engaging the cam plate 27 are the forward cam plate moving assembly 30 and the rear cam plate moving assembly 31. The forward cam plate moving assembly 30 is comprised of a rotating shaft 32, a sprocket 33, cam 34 and bearing 35. The sprocket 33 and the cam 34 are attached to the rotating shaft 32 and the bearing 35, which is itself attached to the lower plate 23, allows the rotating shaft 32 to rotate on an axis parallel to that of projection 29. With its sprocket 33 being positioned between the cam plate 27 and the upper plate 24, the cam plate moving assembly 30 passes through a U-shaped forward recess 36 in the cam plate 37 and through a forward aperture 37 in the lower plate 23. At the forward recess cam 34 bears against cam engaging surfaces of the cam plate 27. The rotating shaft 32 of the forward cam plate moving assembly 30 passes through the forward aperture of the lower plate 23 to where it is retained in position by bearing 35.

The rear cam plate moving assembly 31 is also comprised of a rotating shaft 38, a sprocket 39, cam 40 and bearing 41. The rear cam plate moving assembly 31 is constructed and disposed in manner similar to the front cam plate moving assembly 30 except the cam 40 of the rear cam plate moving assembly 31 is out of phase with the cam 34 of the front cam plate moving assembly by 180°. The rear cam plate moving assembly passes through a U-shaped rear recess 42 in the cam plate and a rear aperture 43 in the lower plate 23. Cam 40 also bears against cam engaging surfaces of cam plate 27 at recess 42, and sprocket 39 is disposed between the upper plate 24 and the cam plate 27. The bearing 41, which is also attached to lower plate 23, holds rotating shaft 38 while allowing its rotation about an axis parallel to that of projection 29.

Also attached to the lower plate 23 is a pair of fluid driven piston and cylinder units **44*a* and 44*b*. These units are comprised, respectively, of cylinders 45*a* and 45*b* and pistons 46*a* and 46*b*. Cylinders 45*a* and 45*b* are, respectively, connected to the projection 29 of lower plate 23 at connections 47*a* and 47*b*. Pistons 46*a* and 46*b* are both connected to opposite ends of chain 48 which is also engaged at intermediate points along its length with sprocket 33**.

Another pair of fluid driven piston and cylinder units **49*a* and 49*b*, made up of cylinders 50*a* and 50*b* and pistons 51*a* and 51*b*, are also attached to the lower plate 23. The cylinders 50*a* and 50*b* are connected to projection 29 at connections 52*a* and 52*b*. The pistons 51*a* and 51*b* of piston and cylinder units 49*a* and 49*b* are connected to opposite ends of chain 53, and chain 53 is connected at intermediate points along its length to sprocket 39. By pressurizing any two of the piston and cylinder units 44*a*, 44*b*, 49*a* and 49*b*, the chains 48 and 53 may be moved so that sprockets 33 and 39 and rotating shafts 32 and 38 are caused to rotate. The resultant movement of the cams 34 and 40 causes the cam plate 27 to move so that it either slides laterally across the surface of lower plate 23 or so that it rotates around the center of projection 29**. The significance of this capability with respect to the overall operation of the cleaning apparatus and the means by which certain specific types of movements are obtained will be explained more fully hereinafter.

Also included on the cam plate 27 are a pair of forward jack apertures **54*a* and 54*b* and a pair of rear jack apertures 55*a* and 55*b* which correspond, respectively, in position to jacks 25*a*, 25*b*, 26*a* and 26*b*. Said jacks pass through their respective jack apertures so that their lower terminal supports rest on the top surface of the lower plate 23. As the cam plate 27 moves, its surfaces on the jack apertures 54*a*, 54*b*, 55*a* and 55*b* push against the jacks 25*a*, 25*b*, 26*a* and 26*b* so that the upper plate 24, and consequently the cleaning apparatus 13, is moved with the cam plate 27. On the other hand, the lower terminal supports of the jacks slide across the top surface of the lower plate 23 so that the lower plate 23 as well as the base support 11** remain stationary.

The upper plate 24 of the movable support 12 has thereon the cleaning element 13 which is attached by a further pair of fluid driven piston and cylinder units **56*a* and 56*b*. Cylinders 57*a* and 57*b* of said piston and cylinder units 56*a* and 56*b* are pivotally connected at connections 58*a* and 58*b* to the upper plate 24 of movable support 12. The pistons 59*a* and 59*b* of piston and cylinder units 56*a* and 56*b* are pivotally connected to the cleaning element 13 at connections 60*a* and 60*b*. The cleaning element 13 includes a cleaning element base section 61 which is connected to pistons 59*a* and 59*b* at connections 60*a* and 60*b* and which is pivotally connected at the end opposite from connections 60*a* and 60*b* to the upper plate 24 at connection 62. As will also be more fully explained, the extension of piston and cylinder units 56*a* and 56*b* will cause the cleaning element base section 61 to pivot on connection 62. Slidably mounted on the cleaning element base section 61 is an electric motor 63 which serves to rotate a telescopically extendable arm 64, the arm itself terminating in a cleaning head 65. The cleaning element 13 is also equipped with means (not shown) for moving the electric motor 63, and with it the arm 64 and the cleaning head 65, forward on the cleaning element base section 61 from its rear position, as is shown in the solid lines in FIG. 1, to a forward position as is, for example, shown in the broken lines in the same figure. This means for moving electric motor 63 may also be employed to return the electric motor 63 along with the arm 64 and the cleaning head to their rear position. The cleaning element 13 is also equipped with means for extending the extendable arm 64 to a position as is, for example, illustrated in the broken lines in FIG. 2**.

Cleaning apparatus 8 is equipped with a reservoir 66 for a fluid which is suitable for driving the above mentioned piston and cylinder units and jacks. An electric motor and pump unit 67 serves to force fluid from reservoir 66 through lines (not shown) to the piston and cylinder units and jacks.

The means by which the cleaning apparatus 8 may be employed to clean the inner surface of the lateral leg 5 of the elbow 3 is illustrated in FIG. 1. The larry car 9 is first moved along rail 10 until a position is reached where the arm 64 is aligned with the vertical center line of the ascension pipe 2. At that point, the larry car 9 is stopped and the cleaning element base section 61 is pivoted on connection 62 until the cleaning element 13, in general, and the extendable arm 64, specifically, are initially aligned with the access opening and the inner surface of the lateral leg 5 of the elbow 3. Such pivoting may be accomplished by varying the extension of pistons **59*a* and 59*b* of piston and cylinder units 56*a* and 56*b*. If there has been no thermal misalignment in the elbow 3, it may then be possible to slide the electric motor 63 and the arm 64 forward on the cleaning element base section 61 to the position shown in the broken lines of FIG. 1. The electric motor 63 causes the arm 64 and the cleaning head 65 to rotate. In the area in which it is in contact, the rotating cleaning head 65 scrapes carbonaceous deposits from the inner surface of the lateral leg 5. As a particular area is cleaned, the arm 64 may be extended and the cleaning head 65 will accordingly be projected still further into the lateral leg 5. If there has been no thermal misalignment in the elbow 3, the arm 64 may be extended to the entire length of the lateral leg 5** so as to effect cleaning of its entire inner surface.

Figure 3:
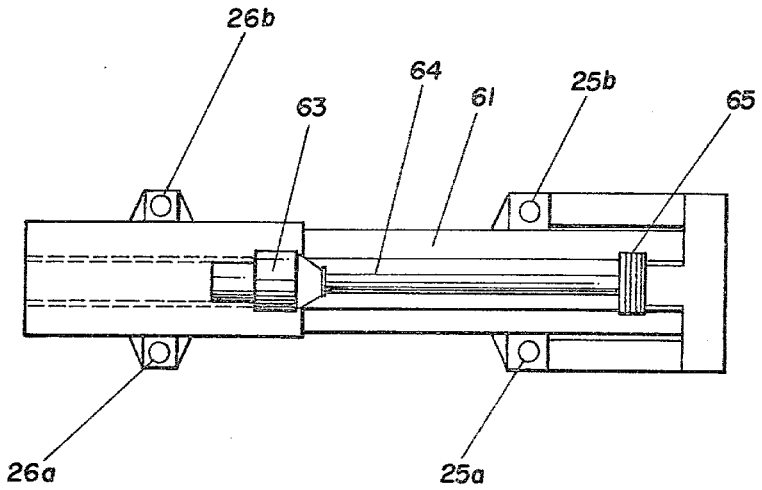
FIG. 3 is a top plan view of the apparatus of the present invention in which its parts are positioned according to the solid lines of FIG. 1.
Figure 4:
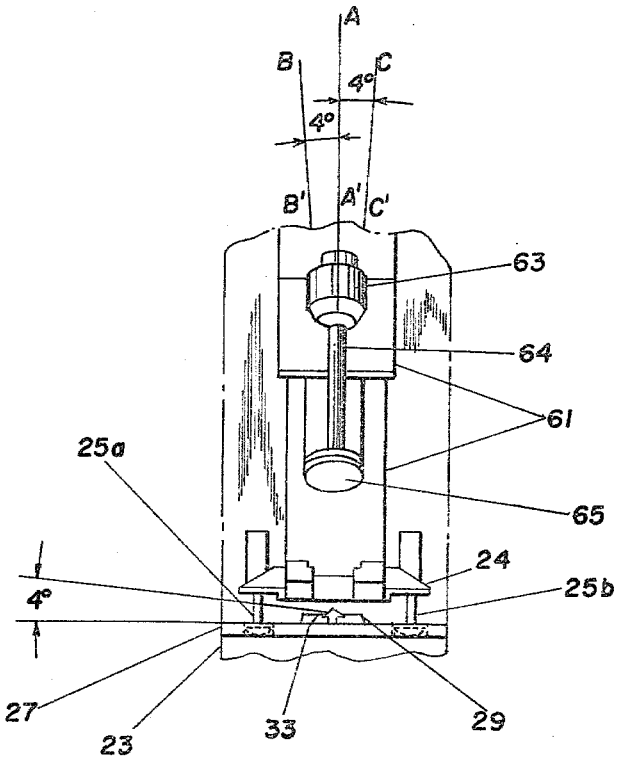
FIG. 4 is a cut away front view of a portion of the apparatus of the present invention.

If, however, the elbow 3 has become thermally misaligned, it may not be possible to extend the arm 64 from its position of initial alignment into or through the entire length of the lateral leg 5. In this event, it may be necessary to further align the cleaning element 13 and its extendable arm 64 by adjusting the position of the movable support 12 and, in particular, the upper plate 24 of the movable support 12. Such adjustments are effected by raising or lowering two or more of the jacks 25*a*, 25*b*, 26*a* and 26*b*. Referring more specifically to FIGS. 3 and 4, it may be seen that when the jacks 25*a* and 26*a* are lowered the upper plate 24 will be tilted so that its position and the position of the cleaning element 13 changes so that the position of the extended vertical center line of the cleaning element 13 in FIG. 4 moves from line A–A' to line B–B'. If, on the other hand, jacks 25*a* and 26*a* are raised and jacks 25*b* and 26*b* are lowered, the extended vertical center line of cleaning element 13 moves to line C–C'. By virtue of such movement, the cleaning element 13 and its arm 64 may be further aligned with the lateral leg 5 of the elbow to compensate for thermal deformation in that structure. It is found that such movement will be adequate to compensate for such thermal misalignment as it is commonly encountered if the cleaning device 8 is constructed so that that cleaning element may be tilted to the left or the right by an angle of 4°. Although a tilt of such magnitude may be obtained by fully lowering jacks 25*a* and 26*a* and by fully raising jacks 25*b* and 26*b*, a smaller tilt may be effected by selecting an intermediate position for one of said pairs of jacks.

Figure 6:
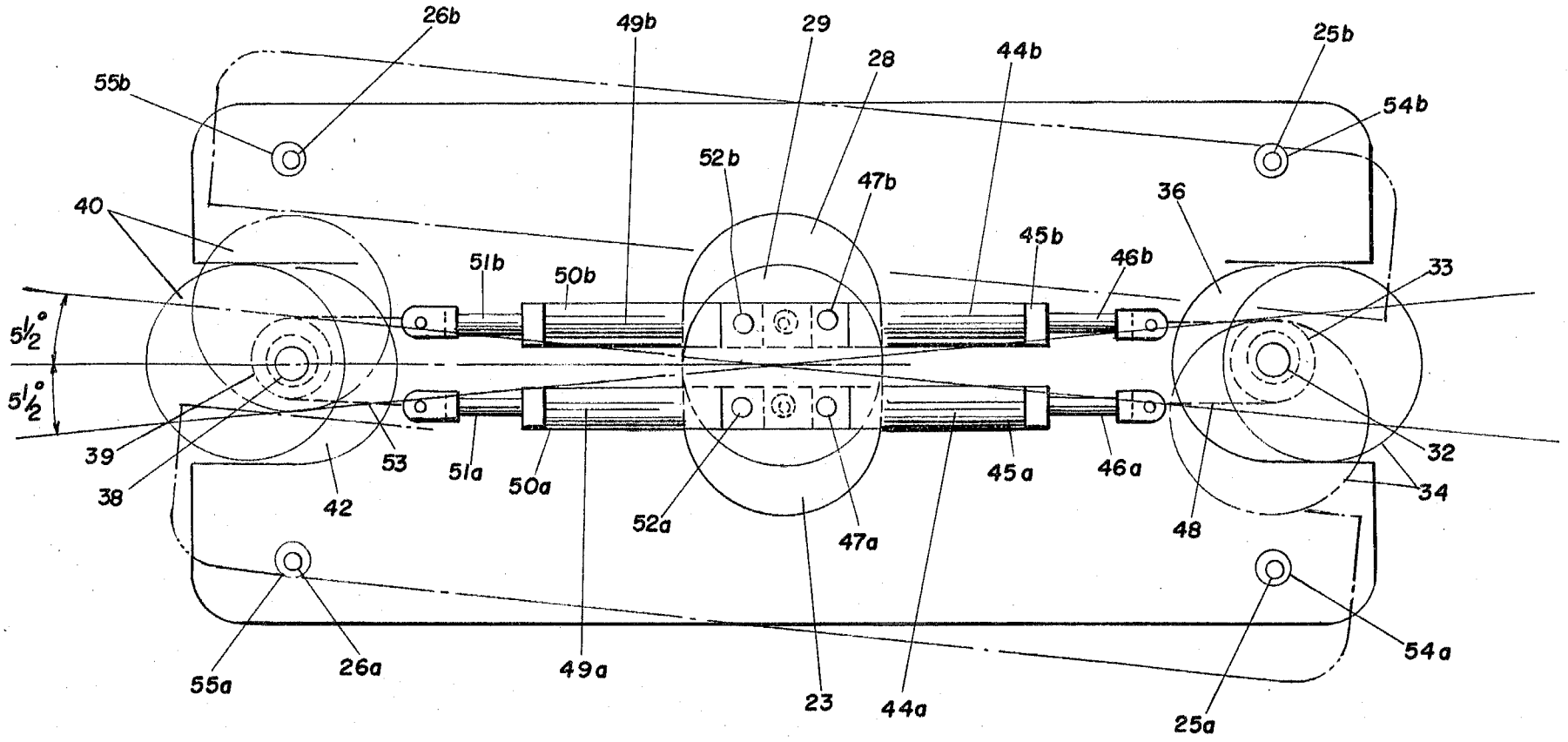
FIG. 6 is a top plan view of the cam plate shown in FIG. 5.

The cleaning element may be still further aligned by adjusting the position of the cam plate 27 with respect to the lower plate 23. Referring to FIG. 6 it may be seen that when piston and cylinder unit 44*a* is pressurized, it pulls on chain 45 so that, along with sprocket 33 and rotating shaft 32, cam 34 rotates in a clockwise direction from its position shown in the solid lines to its position shown in the broken lines. In the same way, when piston and cylinder unit 49*b* is pressurized, chain 53 is pulled so that cam 40 is rotated in a clockwise direction from its position shown in the solid lines to its position shown in the broken lines. The effect of this movement of cams 34 and 40 is that the cam plate 27 rotates in a clockwise direction about the center of projection 29. Accordingly, the surfaces of the cam plate 27 at its jack apertures 54*a*, 54*b*, 55*a* and 55*b* push, respectively, on jacks 25*a*, 25*b*, 25*c* and 25*d*. The upper plate 24, which is fixed to said jacks, will also be rotated in a clockwise direction as will the entire cleaning element 13. Since the lower terminal supports of the jacks will slide across the upper surface of the lower plate 23, said lower plate 23 and the base support 11 will remain stationary. Counterclockwise rotation of the upper plate 24 and the cleaning element 13 may also be effected by moving the cam plate 27 in a counterclockwise direction. Further, it is possible to move the upper plate 24 and the cleaning element 13 in a lateral direction, that is, into and out of the plane of FIG. 1 by moving the cam plate 27 in a lateral direction.

Referring again to FIG. 6, it will be seen that the cam plate 27 is capable of such motion. Counterclockwise rotation of the cam plate 27 is obtained by pressurizing piston and cylinder units 44*b* and 49*a*. The piston and cylinder units 44*b* and 49*a* pull, respectively, on chains 45 and 53 so that cams 34 and 40 are rotated in a counterclockwise direction. Cams 34 and 40 push against the cam engaging surfaces of the cam plate 27 so as to rotate cam plate 27 in a counterclockwise direction on lower plate 23 around the center of projection 29. Such counterclockwise movement causes the upper plate 24 and the cleaning element 13 to rotate in the same direction. It has been found that rotation of the cam plate 27 in the amount of 5½° in either the clockwise or the counterclockwise direction from its position shown in solid lines in FIG. 6 is sufficient to compensate for thermal misalignment in the ascension pipe or the elbow where such turning movement of the cleaning element is required to effect compensation.

By pressurizing other combinations of piston and cylinder units it is also possible to produce lateral motion of the cam plate 27 and consequently of the upper plate 24 and the cleaning element 13. Referring further to FIG. 6, if the piston and cylinder units 44*b* and 49*b* are pressurized, the cam plate 27 will move toward the top of FIG. 6. That is, piston and cylinder unit 44*b* will pull on chain 45 so that the cam 34 will rotate in a counterclockwise direction. At the same time, piston and cylinder unit 49*b* pulls on chain 53 so that cam 40 rotates in a clockwise direction. While cam 34 pushes against the cam engaging surface of the cam plate 27 on the top of recess 36, the cam 40 pushes against the cam engaging surface of the cam plate 27 on the top of recess 43. The effect of such motion is that the entire cam plate 27 slides across the surface of the lower plate 23 in a direction toward the top of FIG. 6. Such movement of the cam plate 27 causes the upper plate 24 and the cleaning element to move into the plane of FIG. 1.

Lateral movement of the cam plate 27 toward the bottom of FIG. 6 can be effected by pressurizing piston and cylinder units 44*a* and 49*a*. Chains 45 and 53 are thereby pulled so that cam 34 is rotated in a clockwise direction and cam 40 is rotated in a counterclockwise direction. Cams 34 and 40 push against the cam engaging surfaces of the cam plate 27 on the bottom side of recesses 36 and 42. Cam plate 27 thereby slides laterally across the surface of lower plate 23 toward the bottom of FIG. 6 and causes the upper plate 24 and the cleaning element 13 to move laterally in the same direction. With respect to such lateral movement, it has been found that a movement of three inches to either one side or the other is generally sufficient to compensate for thermal deformation of the ascension pipe or the elbow requiring this type of position shift.

The cleaning apparatus 8 may also be employed to clean the inner surfaces of the vertical leg 4 of elbow 3 and the ascension pipe 2. To accomplish such cleaning, the cleaning element 13 is disposed vertically as is illustrated in the broken lines in FIG. 2. After the lateral leg 5 has been cleaned, the arm 64 is withdrawn therefrom. The piston and cylinder unit 14 is then extended so that the movable support 12 moves in a vertical arc away from the base support 11 while the movable support arm 19*a* and 19*b* rotate about connections 20*a* and 20*b* and while projections 21*a* and 21*b* move from one end of the arcuate grooves 22*a* and 22*b* to the other. When the piston cylinder units 14*a* and 14*b* are fully extended, the movable support 12 and the cleaning element 13 will be in the position shown in the broken lines in FIG. 2. From this position minor adjustments in the direction of the arm 64 may be effected by varying the extensions of the piston cylinder units 56*a* and 56*b* until the arm 64 is initially aligned with the vertical leg 4 of the elbow 3 and the ascension pipe 2. If the vertical leg 4 of the elbow 3 or the ascension pipe 2 has also been thermally misaligned, compensation for such misalignment may be effected by adjusting two or more of the jacks 25*a*, 25*b*, 26*a*, and 26*b* or by adjusting the position of the cam plate 27. After such alignment has been carried out, the electric motor 63 and the arm 64 are then moved forward on cleaning element base section 61, and by means of the rotating cleaning head 65 the vertical leg 4 and the ascension pipe 2 may then be cleaned. It is also noted that the arm 64 is telescopically extendable and that the broken lines in FIG. 2 show the arm in an extended position. While the arm 64 is of sufficient length in its unextended position to clean the lateral leg 5, it is necessary that it be extended in order to reach all the way to the bottom of the ascension pipe 2. When cleaning of the vertical leg 4 and the ascension pipe 2 is completed, arm 64 may be withdrawn therefrom and the piston and cylinder units 14*a* and 14*b* may be returned to their initial positions, thus moving the apparatus back to its position shown in the solid lines in FIG. 2.

We claim:

1. In a cleaning apparatus carried by a car traveling along a coke oven, having a cleaning element for the cleaning of the inner surface of the lateral legs of ascension pipe elbows, the improvement comprising:

(a) a base support mounted on the car;

(b) a movable support comprising a lower plate connected to the base support and an upper plate superimposed upon and remotely connected to the lower plate;

(c) means for adjusting vertical displacement between said upper and lower plates;

(d) means for laterally and angularly moving the upper plate relative to the lower plate;

(e) said cleaning element being pivotally mounted on the movable support, and comprising a cleaning head mounted on an arm and means for moving said arm in a forward or rearward direction, whereby upon initial alignment of the cleaning element with the lateral leg of the ascension pipe elbow by positioning the car and the base support mounted thereon and by pivoting the cleaning element on the movable support, the cleaning element may be further aligned by adjustment of the position of the upper plate of the movable support.

2. The apparatus defined in claim 1 wherein the arm is telescopically extendable.

3. The apparatus defined in claim 1 wherein means are provided to move the movable support and the cleaning element in a vertical arc away from the base support such that the cleaning element may be initially aligned with the interior surfaces of the vertical leg of the ascension pipe elbow and the ascension pipe, and means to return said movable support and said cleaning element to their position where said cleaning element is in initial alignment with the interior surface of the lateral leg of the ascension pipe elbow.

4. The apparatus defined in claim 3 wherein the cleaning element may be further aligned with the interior surfaces of the vertical leg of the ascension pipe elbow and the ascension pipe by adjustment of the position of the upper plate of the movable support.

5. The apparatus defined in claim 4 wherein the movable support is connected to the base support by at least one lower fluid driven piston and cylinder unit, said piston and cylinder unit being pivotally attached to the base support so as to allow rotation about an axis transverse to the longitudinal axis of the piston and cylinder unit, and in which the upper end of said piston and cylinder unit is pivotally attached to the movable support so as to allow rotation about an axis parallel to the axis of rotation of the pivotal connection of the lower end of the lower piston and cylinder unit to the base support.

6. The apparatus defined in claim 5 wherein the movable support has at least one downwardly extending arm which is pivotally attached to the base support so as to allow the movable support to rotate about an axis which is parallel to the axis of rotation of the pivotal connection of the lower end of the first piston and cylinder unit to the base support.

7. The apparatus defined in claim 1 wherein said means for adjusting vertical displacement between said upper and lower plates comprises at least two jacking means, said jacking means capable of either simultaneous or separate employment such that said upper and lower plates may be adjustably disposed so that the respective planes in which the upper and lower plates lie may be in either parallel or intersecting relation.

8. The apparatus defined in claim 7 wherein the jacking means are fixed to the upper plate and bear against the lower plate.

9. The apparatus defined in claim 8 wherein said means for laterally and angularly moving the upper plate relative to the lower plate comprises:

(a) a cam plate, said cam plate having apertures through which the jacks pass and having on two of its opposite sides cam engaging surfaces;

(b) a pair of cam plate moving assemblies, comprising a shaft and an attached cam, said assemblies being disposed so that their cams bear against the cam engaging surfaces so that they are out of phase with one another by 180°; and (c) means for selectively rotating the shafts of the cam plate moving assemblies in either clockwise or counterclockwise direction.

10. The apparatus defined in claim 7 wherein said upper and lower plates are rectangular and have sides and front and rear ends and wherein said upper plate is superimposed directly over said lower plate such that its sides are parallel to the sides of the lower plate, and wherein said plates are remotely connected one to the other by four jacking means, two of said jacking means being disposed on opposite sides of the plates at an equal distance adjacent said front ends of said plates and two of said jacking means being disposed also on opposite sides of the plates at an equal distance adjacent said rear ends of said plates.

11. The apparatus defined in claim 7 wherein the upper and lower plates may be disposed in planes which intersect at an angle equal to or less than about 4°.

12. The apparatus defined in claim 1 wherein the upper plate of the movable support is pivotally connected at its front end to the cleaning element so as to allow rotation of the cleaning element about an axis parallel to the axis of rotation of the pivotal connection of the lower end of the lower piston and cylinder unit to the base support.

13. The apparatus defined in claim 12 wherein the arm of the cleaning element is slidably mounted on a cleaning element base section, said cleaning element base section being, itself, pivotally mounted at its front end to the upper plate of the movable support, and wherein there is provided a means for sliding said arm in a forward or rearward direction on said cleaning element base section.

14. The apparatus defined in claim 1 wherein the upper plate of the movable support is connected in the vicinity of its rear end to the lower end of at least one upper piston and cylinder unit so as to allow rotation about an axis parallel to the axis of rotation of the pivotal connection of the lower end of the first piston and cylinder unit to the base support, and wherein the upper end of the upper piston and cylinder unit is pivotally connected to the cleaning element base section so as to also allow rotation about an axis which is parallel to said axis of rotation of the pivotal connection of the lower end of the lower piston and cylinder unit to the base section.

15. The apparatus defined in claim 1 including a means for extending and rotating the arm.

* * * * *